US005408853A

United States Patent [19]

Yamada

[11] Patent Number: 5,408,853

[45] Date of Patent: Apr. 25, 1995

[54] DOOR LOCKING HANDLE ASSEMBLY

[75] Inventor: Kenichi Yamada, Tokyo, Japan

[73] Assignee: Takigen Manufacturing Co. Ltd., Tokyo, Japan

[21] Appl. No.: 197,061

[22] Filed: Feb. 16, 1994

[30] Foreign Application Priority Data

Mar. 2, 1993 [JP] Japan ..... 5-066090

[51] Int. Cl.[6] ..... E05B 13/10

[52] U.S. Cl. ..... 70/210; 70/224

[58] Field of Search ..... 70/207–211, 70/214–216, 224, DIG. 31; 292/336.3, 347, 348, DIG. 27

[56] References Cited

U.S. PATENT DOCUMENTS

| | | | |
|---|---|---|---|
| 4,484,462 | 11/1984 | Berkowitz | 70/368 |
| 4,505,139 | 3/1985 | Richards | 70/221 |
| 4,535,613 | 8/1985 | Mastromatteo | 70/221 |
| 4,604,879 | 8/1986 | Neary et al. | 70/224 |
| 4,655,059 | 4/1987 | Best et al. | 70/224 |
| 4,706,478 | 11/1987 | Swan et al. | 70/208 |
| 5,156,359 | 10/1992 | Nobel et al. | 244/129.4 |

*Primary Examiner*—Peter M. Cuomo
*Assistant Examiner*—Monica E. Millner
*Attorney, Agent, or Firm*—Martin Smolowitz

[57] ABSTRACT

There is provided a door locking handle assembly. In the assembly, a cross pivot 17 is prevented from dropping out of the assembly. The pivot 17 mounted in a base-end portion of a lock lever 13 is received in a bearing groove 19 formed in an inner portion of a handle 18. A ring 26 provided with a pivot keeper 27 and a stop projection 28 is mounted in a receiving groove 21 of aft intermediate portion of a cylindrical portion 20 of the handle 18 in an insertion manner, so that the cross pivot 17 is prevented by the pivot keeper 27 from moving. Through such cross pivot 17 the lock lever 13 is pivoted to the handle 18.

3 Claims, 5 Drawing Sheets

DOOR LOCKING HANDLE ASSEMBLY

BACKGROUND OF THE INVENTION

1. Field of the Invention

The present invention relates to a door locking handle assembly used in a freight container mounted on a truck and to that used in a walk-in type refrigerator.

2. Description of the Prior Art

In a conventional door locking handle assembly: a shaft portion of a handle is mounted in an axial hole of a cylindrical portion of a stationary body in an insertion manner so as to be rotatable but not axially slidable, the stationary body being fixedly mounted on a door; an engaging groove is provided in an inner peripheral surface of the stationary body; a lock lever is pivoted to an axial hole of the handle through a cross pivot; the engaging groove of the stationary body is engaged with a front-end portion of the lock lever so that the handle is held in a predetermined position, the lock lever being urged by a biasing spring to have its front-end portion engaged with the engaging groove of the stationary body; a swing-angle limiting plate, which is mounted on a square-column portion of a rear-end shaft portion of the handle in an insertion manner, abuts against a wall surface of a swing-angle limiting projection of a rear side of the cylindrical portion of the stationary body to limit a swing angle of the handle; a lock unit is fixedly embedded in a lock-receiving groove of the stationary body; a catch plate is mounted on a rotor of the lock unit, the catch plate being moved back and forth as the rotor rotates; and, the catch plate engages with a locking groove of a base-end portion of the handle to lock up the handle.

However, in the conventional door locking handle assembly described above, since the cross pivot through which the lock lever is pivoted to the handle is inserted in the handle's axial holes opening outward, there is a fear that the cross pivot is pushed out of the handle's axial holes by inserting a stick and the like into the handle's axial holes from the outside to unlock the handle illegally.

SUMMARY OF THE INVENTION

It is an object of the present invention to provide a door locking handle assembly in which a cross pivot is prevented from being illegally pushed out of the assembly, so that a handle is locked up in a safety manner.

The above objects of the present invention are accomplished by providing:

a door locking handle assembly comprising:

a lock lever provided with a base-end portion in which a cross pivot is mounted;

a handle which is provided with a bearing groove in its inner portion and provided with a shaft portion, formed in an intermediate portion of which shaft portion is a receiving groove for fixedly mounting a ring therein in an insertion manner, the ring being provided with a pivot keeper and a stop projection, the bearing groove receiving the cross pivot therein;

the cross pivot being received in the bearing groove of the handle, so as to be prevented by the pivot keeper from moving in a direction perpendicular to a longitudinal direction of the cross pivot;

the lock lever being pivoted to the handle through the cross pivot;

a stationary body provided with a cylindrical portion with an axial hole in which the shaft portion of the handle is mounted so as to be rotatable but not axially slidable relative to the stationary body;

the stationary body being further provided with a circularly-curved receiving groove in an inner peripheral surface of the cylindrical portion thereof, the circularly-curved receiving groove being provided with a projection in its intermediate portion, the projection dividing the circularly-curved groove into a right half groove and a left half groove in one of which grooves an iron piece is fitted, and the remaining one of which grooves receives the stop projection of the ring so as to be movable therein;

the stationary body being further provided with an engaging groove in the inner peripheral surface of the cylindrical portion thereof, the engaging groove being engaged with a front-end portion of the lock lever to hold the handle in a predetermined position;

a biasing spring for urging the lock lever to have its front-end portion engaged with the engaging groove of the stationary body;

a lock unit fixedly embedded in a lock-receiving groove of the stationary body, the lock unit being provided with a rotor, mounted on which rotor is a wide catch plate which is moved back and forth as the rotor rotates; and the handle being further provided with a locking groove in its base-end portion, the locking groove being engaged with the catch plate to lock up the handle.

DESCRIPTION OF THE PREFERRED EMBODIMENTS

Figure 1:
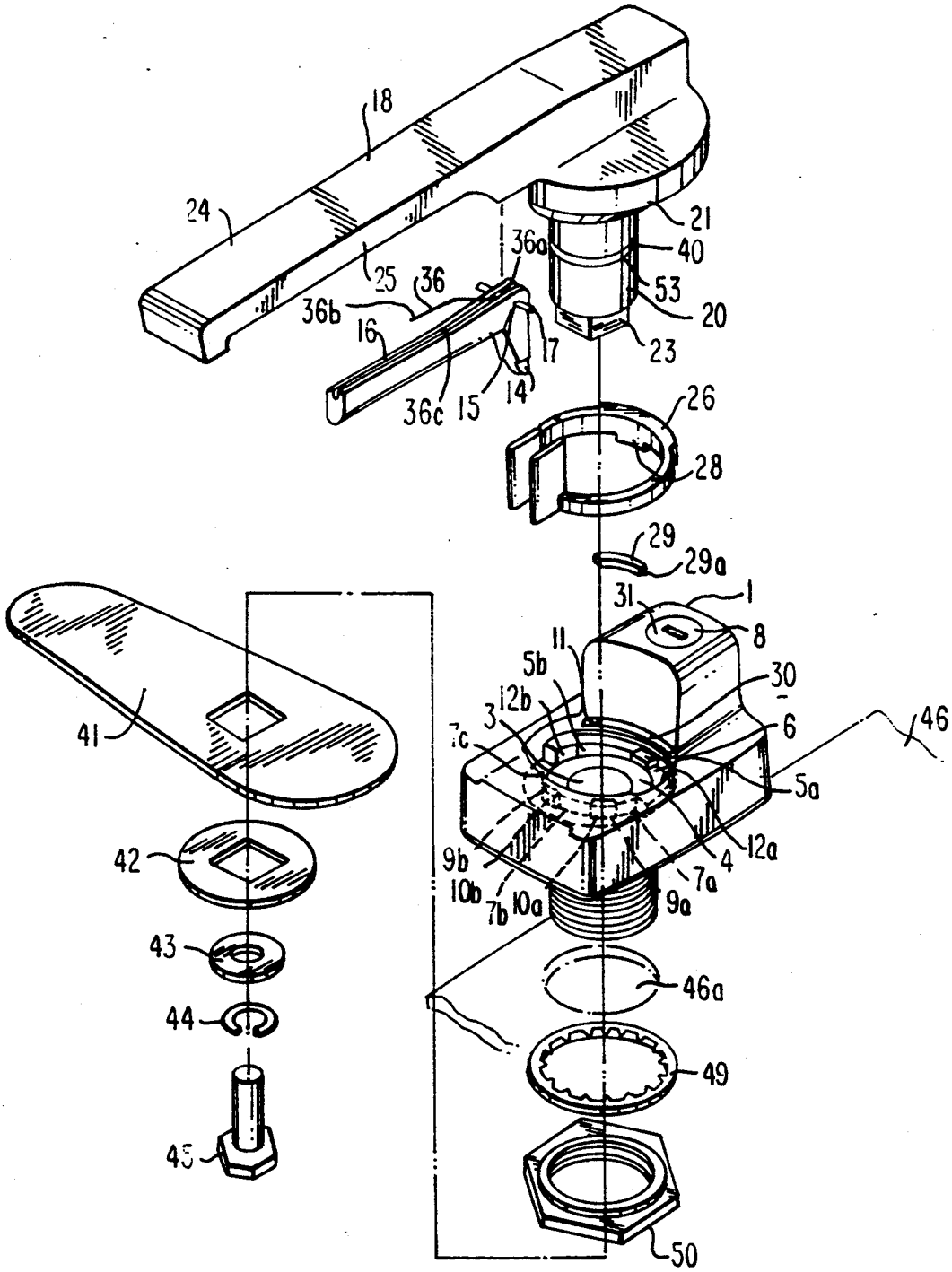
FIG. 1 is a perspective view of an embodiment of the door locking handle assembly of the present invention.
Figure 2:
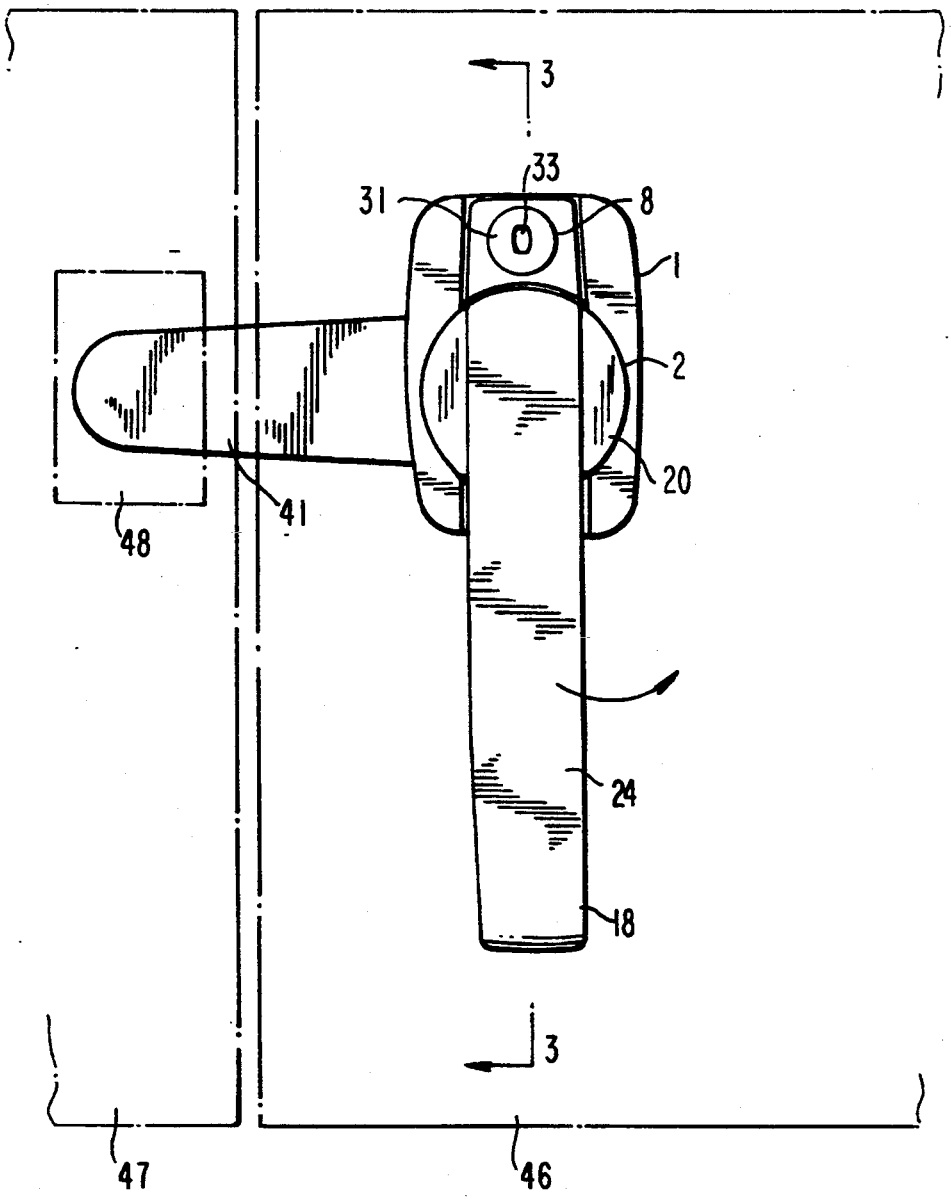
FIG. 2 is a front view of the door locking handle assembly of the present invention shown in FIG. 1.
Figure 3:
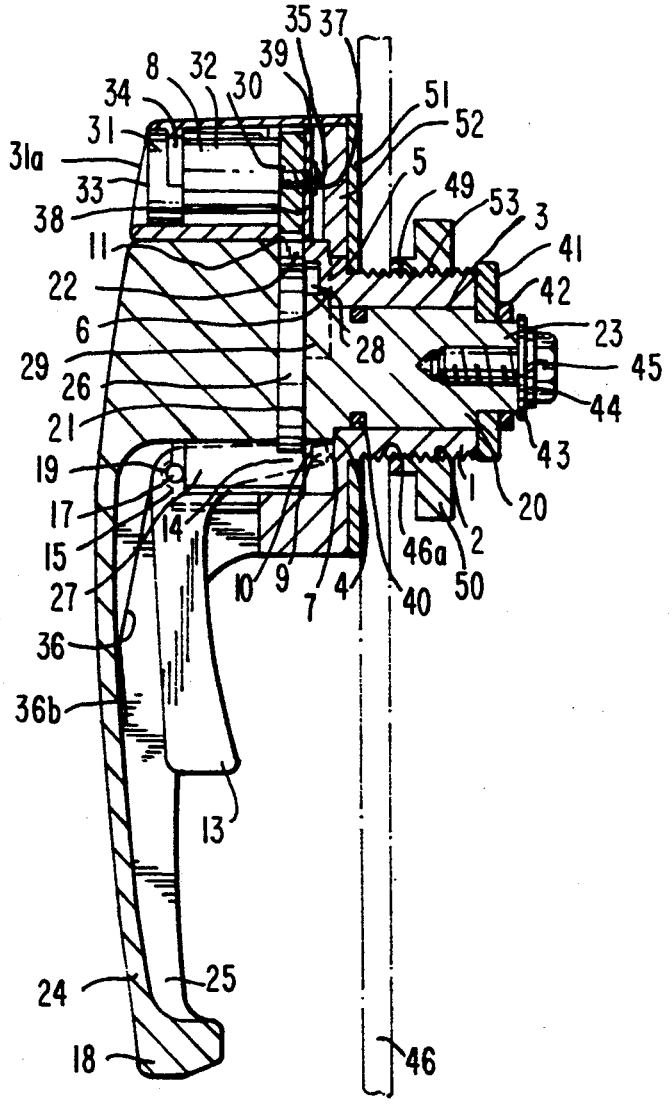
FIG. 3 is a sectional view of the door locking handle assembly of the present invention, taken along the line 3—3 of FIG. 2.

Hereinbelow, the present invention will be described in detail with reference to the accompanying drawings and the reference numerals and characters.

In a door locking handle assembly of the present invention, a lock lever 13 is provided with a base-end portion in which a cross pivot 17 is mounted. A handle 18 is provided with a bearing groove 19 in its inner portion and further provided with a shaft portion 20. The bearing groove 19 of the handle 18 receives the cross pivot 17 therein. Formed in an intermediate portion of the shaft portion 20 of the handle 18 is a receiving groove 21 for fixedly mounting a ring 26 therein in an insertion manner. The ring 26 is provided with a pivot keeper 27 and a stop projection 28. The cross pivot 17 is received in the bearing groove 19 of the handle 8, so as to be prevented by the pivot keeper 27 from moving in a direction perpendicular to a longitudinal direction of the cross pivot 17. The lock lever 13 is pivoted to the handle 18 through the cross pivot 17.

A stationary body 1 is provided with a cylindrical portion 2 with an axial hole 3 in which the shaft portion 20 of the handle 18 is mounted so as to be rotatable but not axially slidable relative to the stationary body 1. The stationary body 1 is further provided with a circularly-curved receiving groove 5 in an inner peripheral surface 4 of the cylindrical portion 2 thereof. The circularly-curved receiving groove 5 is provided with a projection 6 in its intermediate portion. The projection 6 divides the circularly-curved groove 5 into a right half groove **5*a* and a left half groove 5*b*, and in one of which grooves 5*a*, 5*b* an iron piece 29 is fitted, and the remaining one of which grooves 5*a*, 5*b* receives the stop projection 28 of the ring 26** so as to be movable therein.

The stationary body 1 is further provided with an engaging groove 7 in the inner peripheral surface 4 of the cylindrical portion 2 thereof. The engaging groove 7 is engaged with a front-end portion 14 of the lock lever 13 to hold the handle 18 in a predetermined position. A biasing spring 36 urges the lock lever 13 to have its front-end portion 14 engaged with the engaging groove 7 of the stationary body 1.

Further, in the door locking handle assembly of the present invention, a lock unit 31 is fixedly embedded in a lock-receiving groove 8 of the stationary body 1. The lock unit 31 is provided with a rotor 32, mounted on which rotor 32 is a wide catch plate 30 which is moved back and forth as the rotor 32 rotates. The handle 18 is further provided with a locking groove 22 in its base-end portion, the locking groove 22 which is engaged with the wide catch plate 30 to lock up the handle 18.

In a door locking handle assembly of the present invention, as shown in FIG. 1, the stationary body 1 is fixedly mounted on a door 46. A catch plate 41 is mounted on a square-column portion 23 of a rear-end shaft portion 20 of the handle 18 in an insertion manner, and has its front-end portion engaged with a receiving portion 48 of a stationary frame element 47 so as to lock up the door 46.

In order to lock up the door 46, the handle 18, a longitudinal axis of which is in a vertical plane when the handle 18 is locked up in its vertical position, is side-swung to reach its horizontal position so that the catch plate 41 is side-swung together with the handle 18 so as to be free from the receiving portion 48 of tile stationary frame element 47, whereby the door 46 is unlocked. Opening and closing operations of the door 46 is performed in a condition in which the handle 18 is held in its horizontal position.

The cross pivot 17 mounted on the base-end portion of the lock lever 13 is inserted into the bearing groove 19 provided in the inner portion of the handle 18. The ring 26 provided with the pivot keeper 27 and stop projection 28 is fixedly received in the receiving groove 21 (which is provided in the intermediate portion of the shaft portion 20 of the handle 18) in an insertion manner, so that the cross pivot 17 is held by the pivot keeper 27 and received in the bearing groove 19 so as not to be axially movable relative to the groove 19, whereby the lock lever 13 is pivoted to the handle 18.

The engaging groove 7 provided in the inner peripheral surface 4 of the cylindrical portion 2 of the stationary body 1 is engaged with the front-end portion 14 of the lock lever 13, so that the handle 18 is held in the vertical position or the horizontal position thereof. In order to side-swing or rotate the handle 18, the lock lever 13 is pulled up so that the front-end portion 14 of the lock lever 13 is disengaged from the engaging groove 7 of the stationary body 1. The lock lever 13 is urged by the biasing spring 36 to have its front-end portion 14 engaged with the engaging groove 7 of the stationary body 1. When the handle 18 reaches the vertical position or the horizontal position thereof, the front-end portion 14 of the lock lever 13 is automatically engaged with the engaging groove 7 of the stationary body 1 so that the handle 18 is held in its predetermined position.

The circularly-curved receiving groove 5 provided in the inner peripheral surface 4 of the cylindrical portion 2 of the stationary body 1 is provided with the projection 6 in its intermediate portion. By the projection 6, the circularly-curved groove 5 is divided into the right half groove **5*a* and the left half groove 5*b* in one of which grooves 5*a*, 5*b* the iron piece 29 corresponding to that one in shape is fitted, and the remaining one of which grooves 5*a*, 5*b* receives the stop projection 28 of the ring 26 so as to be movable therein. The ring 26 is fixedly mounted in the receiving groove 21 of the intermediate portion of the shaft portion 20 of the handle 18. The shaft portion 20 of the handle ! 8 is mounted in the axial hole 3 of the cylindrical portion 2 of the stationary body 1, so as to be rotatable but not axially slidable relative to the stationary body 1. The stop projection 28 of the ring 26 abuts against a wall surface 12*a* of the receiving groove 5*a* or against a wall surface 12*b* of the receiving groove 5*b*, and also abuts against a wail surface 29*a* of the iron piece 29, so that the handle 18 is restricted in its swinging angle and swinging direction. Although the swinging direction of the handle 18 depends on the door 46 and the stationary body 47 in arrangement, it is also possible to change the swinging direction of the handle 18 by changing the receiving groove 5*a*, 5*b* in which the iron piece 29** should be mounted.

The lock unit 31 fixedly embedded in the lock-receiving groove 8 of the stationary body 1 is provided with the rotor 32, mounted on which rotor 32 is the wide catch plate 30 which is moved back and forth as the rotor 32 rotates. The handle 18 is held in its vertical position so that the catch plate 41 is engaged with the receiving portion 48 of the stationary frame element 47. Then, a key is inserted in a keyhole 33 to rotate the rotor 32 to have the wide catch plate 30 engaged with the locking groove 22 of the base-end portion of the handle 18, so that the handle 18 is locked up to lock up the door 46.

The door 46 is provided with a through-hole **46*a* into which the cylindrical portion 2 of the stationary body 1 is inserted. Then, a washer 49 for preventing the stationary body 1 from rotating is mounted on the cylindrical portion 2 of the stationary body 1 in an insertion manner from the rear of the door 46, and a nut 50 is threadably engaged with the cylindrical portion 2 of the stationary body 1 to fix the body 1 to the door 46. A packing 51 is interposed between a bottom portion of the stationary body 1 and a front surface of the door 46**.

Figure 6:
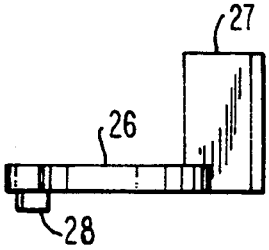
FIG. 6 is a front view of the ring of the door locking handle assembly of the present invention shown in FIG. 1.
Figure 7:
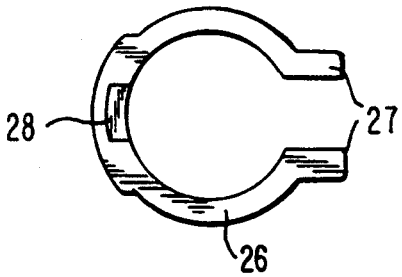
FIG. 7 is a bottom view of the ring shown in FIG. 6.

Provided inside the handle 18 are a right and a left bearing groove 19 in which the opposite end portions of the cross pivot 17 mounted in the axial hole 15 of the base-end portion of the lock lever 13 in an insertion manner are received. As shown in FIGS. 6 and 7, the ring 26 provided with the pivot keeper 27 and the stop projection 28 is fixedly mounted in the receiving groove 21 of the intermediate portion of the shaft portion 20 of the handle 18 in an insertion manner, so that the bearing grooves 19 are filled up with the pivot keeper 27 to prevent the cross pivot 17 from moving in a direction perpendicular to its longitudinal direction, whereby the lock lever 13 is pivoted to the handle 18 through the cross pivot 17.

Figure 8:
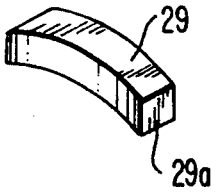
FIG. 8 is a perspective view the iron piece of the door locking handle assembly of the present invention shown in FIG. 1.
Figure 9:
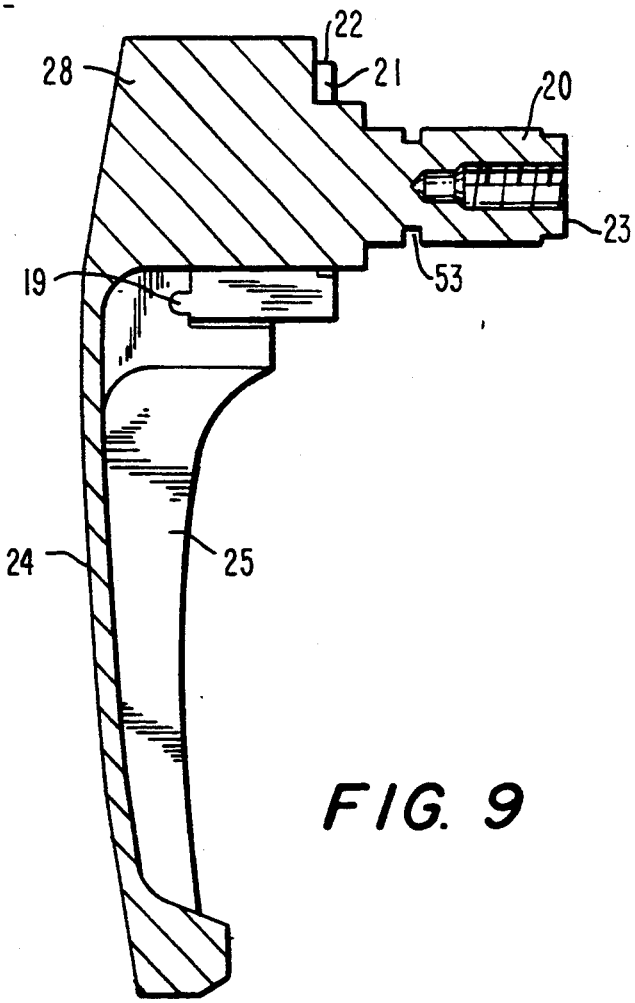
FIG. 9 is a longitudinal sectional view of the handle of the door locking handle assembly of the present invention shown in FIG. 1.

Provided in the base-end portion of the inner peripheral surface 4 of the cylindrical portion 2 of the stationary body 1 are the right and left circularly-curved receiving groove 5*a*, 5*b* having been symmetrically divided by its central projection 6. In the embodiment of the present invention described above, since the handle 18 is side-swung or rotated clockwise from its vertical position, the iron piece 29 corresponding in shape to the left one 5*b* of the circularly-curved receiving grooves 5*a*, 5*b* is fitted in the left one 5*b*. Consequently, the iron piece 29 is circularly-curved in shape, as shown in FIG. 8. The shaft portion 20 of the handle 18 is rotatably mounted in the axial hole 3 of the cylindrical portion 2 of the stationary body 1 in an insertion manner. The stop projection 28 of the ring 26 is movable in the circularly-curved receiving groove 5*a* between the wall surface 12*a* and the wall surface 29*a* of the iron piece 29, and abuts against these wall surfaces 12*a*, 29*a* to limit the handle 19 in side-swinging angle and restrict the handle 18 so as to side-swing or rotate only clockwise from its vertical position.

Provided in the front-end portion of the inner peripheral surface 4 of the cylindrical portion 2 of the stationary body 1 are three engaging grooves 7 which engage with the front-end portion 14 of the lock lever 13 to hold the handle 18 in the predetermined position. The biasing spring 36 is constructed of a coil spring which has: its coiled portion 36*a* mounted on the cross pivot 17; its one linear end portion 36*b* abut on a recess 25 which is formed in a rear side of a grip portion 24 Of the handle 18 for receiving the lock lever 13 therein; and its remaining linear end portion 36*c* abut on a recess 16 in an upper surface of the lock lever 13, so that the lock lever 13 is so urged as to have its front-end portion 14 engaged with the engaging groove 7 of the stationary body 1. In order to side-swing or rotate the handle 18, it is necessary to pull up the lock lever 13 against the biasing spring 36 so that the front-end portion 14 of the lock lever 13 is disengaged from the engaging groove 7 of the stationary body 1. After completion of such disengagement of the lock lever 13 from the engaging groove 7, the handle 18 is side-swung. During such side-swinging or rotating operation of the handle 18, the front-end portion 14 of the lock lever 13 abuts against a side surface 10 of a projection 9 provided between the engaging grooves 7. In a condition in which the lock lever 13 is released from the user's pulling effort or the effort is less than the resilient force exerted by the biasing spring 36, the front-end portion 14 of the lock lever 13 is automatically engaged with the engaging groove 7 when the handle 18 reaches such engaging groove 7, so that the handle 18 is held in the predetermined position. In the embodiment of the present invention described above, when the handle 18 is held in its vertical position, the front-end portion 14 of the lock lever 13 is engaged with the engaging groove 7*b*. On the other hand, when the handle 18 is held in its horizontal position, the front-end portion 14 of the lock lever 13 is engaged with the engaging groove 7*c*.

Figure 5:
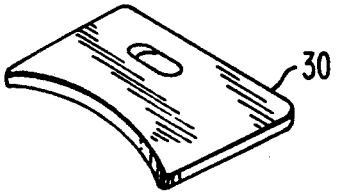
FIG. 5 is a perspective view the catch plate of the door locking handle assembly of the present invention shown in FIG. 1.

The lock unit 31 is fixedly embedded in the use of a press-fitted pin 34. The wide catch plate 30 is fixedly mounted on a shaft portion 35 of the rotor 32, and is vertically movable between a bottom portion 31*a* of the lock unit 31 and a dropping-out prevention plate 39 which fixed to the lock-receiving groove 8 by the use of the screw 37, so that a front-end portion of the wide catch plate 30 is projected through a space 11 through which the lock-receiving groove 8 communicates with a space defined by the inner peripheral surface 4 of the cylindrical portion 2 of the stationary body 1. The-handle 18 is locked up to lock up the door 46 when: the handle 18 is held in its vertical position so that the catch plate 41 is engaged with the receiving portion 48 of the stationary frame element 47, and then the key is inserted in the keyhole 33 of the lock unit 31 to rotate the rotor 32 thereof so that the front-end portion of the wide catch plate 30 is engaged with the engaging groove 22 of the base-end portion of the handle 18. As shown in FIG. 5, the wide catch plate 30 is wide, and, therefore has a sufficient strength. A lid element 52 is mounted on the bottom portion of the lock-receiving groove 8 of the stationary body 1.

As shown in FIG. 1, an annular groove 53 of an intermediate portion of the shaft portion 20 of the handle 18 receives a watertight O-ring 40 therein. Mounted on a square-column portion 23 formed in the rear-end portion of the shaft portion 20 of the handle 18 in an insertion manner is the catch plate 41 which is fixed to the square-column portion 23 of the handle 18 by a bolt 45. In case that the handle 18 is held in its vertical position, the catch plate 41 is projected from the-door 46 to engage with the receiving portion 48 of the stationary frame element 47. On the other hand, in case that the handle 18 is held in its horizontal position, the catch plate 41 is retracted inside the handle 18 so that the catch plate 41 is disengaged from the receiving portion 48 of the stationary frame element 47. The opening and closing operations of the door 46 are performed in a condition in which the handle 18 is held in its horizontal position.

Figure 4:
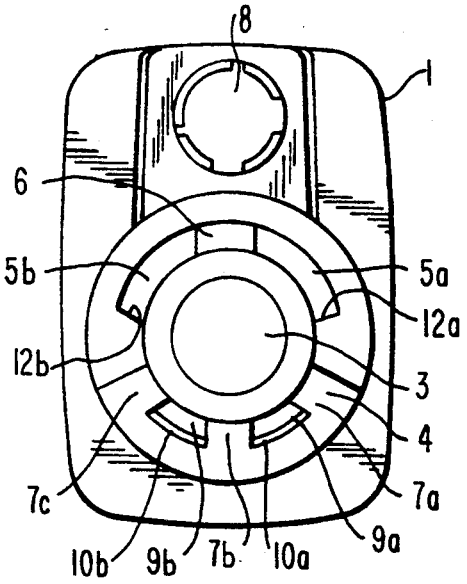
FIG. 4 is a plan view of the stationary body of the door locking handle assembly of the present invention shown in FIG. 1.

The side-swinging direction or rotating direction thereof depends on the door 46 and the stationary frame element 47 in arrangement. Consequently, when it is necessary to side-swing or rotate the handle 18 in a direction opposite to that of the above embodiment of the present invention, the iron piece 29 is mount in the right one 5*a* of the circularly-curved receiving grooves 5*a*, 5*b* as viewed in FIG. 4 in assembling, so that the stop projection 28 of the ring 26 is mounted in the remaining one 5*b* of the receiving grooves 5*a*, 5*b* so as to be movable therein, whereby the handle 18 is so restricted as to side-swing or rotate only counterclockwise from its vertical position in contrast with the above-described embodiment of the present invention.

As described above, in the door locking handle assembly of the present invention: the lock lever 13 is provided with a base-end portion in which the cross pivot 17 is mounted; the handle 18 is provided with the bearing groove 19 in its inner portion and further provided with the shaft portion 20; the bearing groove 19 of the handle 18 receives the cross pivot 17 therein; formed in the intermediate portion of the shaft portion 20 of the handle 18 is the receiving groove 21 for fixedly mounting the ring 26 therein in an insertion manner; the ring 26 is provided with the pivot keeper 27 and the stop projection 28; the cross pivot 17 is received in the bearing groove 19 of the handle 8 so as to be prevented by the pivot keeper 27 from moving in the direction perpendicular to the longitudinal direction of the cross pivot 17; and, the lock lever 13 is pivoted to the handle 18 through the cross pivot 17. Consequently, the opposite end portion of the cross pivot 17 are received inside the handle 18, and, therefore not exposed to the outside, which make is impossible to illegally pull out the the cross pivot 17 from the outside. As a result, there is no fear that the door locking handle assembly of the present invention is illegally unlocked by pulling out the cross pivot 17. Further, since the cross pivot 17 is received inside the handle 18, the door locking handle assembly of the present invention is also improved in appearance.

Furthermore, in the door locking handle assembly of the present invention: tile shaft portion 20 of the handle 18 is mounted in the axial hole 3 of the cylindrical portion 2 of the stationary body 1 in an insertion manner so as to be rotatable but not axially slidable in the cylindrical portion 2; provided in the base-end portion of the inner peripheral surface 4 of the cylindrical portion 2 of the stationary body 1 are the right and left circularly-curved receiving groove 5*a*, 5*b* having been symmetrically divided by its central projection 6; the iron piece 29 corresponding in shape to one of the circularly-curved receiving grooves 5*a*, 5*b* is fitted in that one; and, the remaining one of the circularly-curved receiving grooves 5*a*, 5*b* receives the stop projection 28 of the ring 26 so as to be movable therein. Consequently, it is possible to change the side-swinging direction or rotating direction of the handle 18, which improves the door locking handle assembly of the present invention in applicability in arrangement of the door 46 and the stationary frame element 47.

Further, in the door locking handle assembly of the present invention, since the pivot keeper 27 is integrally formed with the stop projection 28 into the ring 26, it is possible to reduce the number of the parts, and, therefore reduce their molds, which considerably saves the manufacturing costs.

Further, in the present invention: the lock unit 31 is fixedly embedded in the lock-receiving groove 8 provided in the stationary body 1; the wide catch plate 30, which moves back and forth as the rotor 32 of the lock unit 31 rotates, is fixedly mounted on the rotor 32; and, the wide catch plate 30 is engaged with the locking groove 22 of the base-end portion of the handle 18 to lock up the handle 18. Since the wide catch plate 30 used in the present invention is wider than the conventional one, the door locking handle assembly of the present invention is improved in strength.

What is claimed is:

1. A door locking handle assembly comprising:

a lock lever 13 provided with a base-end portion in which a cross pivot 17 is mounted;

a handle 18 which is provided with a bearing groove 19 in its inner portion and provided with a shaft portion 20, formed in an intermediate portion of which shaft portion 20 is a receiving groove 21 for fixedly mounting a ring 26 therein in an insertion manner, said ring 26-being provided with a pivot keeper 27 and a stop projection 28, said bearing groove 19 receiving said cross pivot 17 therein;

said cross pivot 17 being received in said, bearing groove 19 of said handle 18, so as to be prevented by said pivot keeper 27 from moving in a direction perpendicular to a longitudinal direction of said cross pivot 17;

said lock lever 13 being pivoted to said handle 18 through said cross pivot 17;

a stationary body 1 provided with a cylindrical portion 2 with an axial hole 3 in which said shaft portion 20 of said handle 18 is mounted so as to be rotatable but not axially slidable relative to said stationary body 1;

said stationary body 1 being further provided with a circularly-curved receiving groove 5 in an inner peripheral surface 4 of said cylindrical portion 2 thereof, said circularly-curved receiving groove 5 being provided with a projection 6 in its intermediate portion, said projection 6 dividing said circularly-curved groove 5 into a right half groove 5*a* and a left half groove 5*b* in one of which grooves 5*a*, 5*b* an iron piece 29 is fitted, and a remaining one of which grooves 5*a*, 5*b* receives said stop projection 28 of said ring 26 so as to be movable therein;

said stationary body 1 being further provided with an engaging groove 7 in said inner peripheral surface 4 of said cylindrical portion 2 thereof, said engaging groove 7 being engaged with a front-end portion 14 of said lock lever 13 to hold said handle 18 in a predetermined position;

a biasing spring 36 for urging said lock lever 13 to have its front-end portion 14 engaged with said engaging groove 7 of said stationary body 1;

a lock unit 31 fixedly embedded in a lock-receiving groove 8 of said stationary body 1, said lock unit 31 being provided with a rotor 32, mounted on which rotor 32 is a wide catch plate 30 which is moved back and forth as said rotor 32 rotates; and said handle 18 being further provided with a locking groove 22 in its base-end portion, said locking groove 22 being engaged with said wide catch plate 30 to lock up said handle 18.

2. The door locking handle assembly according to claim 1, wherein said stationary body 1 is fixed mounted onto a doors 46 and a catch plate 41 is mounted on a square-column portion 23 of said handle 18, said catch plate 41 having its front end portion engaged with a stationary frame 47.

3. The door locking handle assembly according to claim 2, wherein said stationary body 1 has a cylindrical portion 2 which is inserted into a through hole 46*a* in the door 46, and a nut 50 is thereby engaged with the cylindrical portion 2 so as to enclose a washer 49 and packing 51 between the stationary body 1 and the door 46.

* * * * *